US005560665A

United States Patent [19]

Kelley

[11] Patent Number: 5,560,665

[45] Date of Patent: Oct. 1, 1996

[54] COMPACT LIGHTWEIGHT FOLDABLE SKI EQUIPMENT CARRIER

[76] Inventor: Patrick S. Kelley, 8914 Spring Valley Dr., Boynton Beach, Fla. 33437

[21] Appl. No.: 525,396

[22] Filed: Sep. 8, 1995

[51] Int. Cl.[6] ..... A63C 11/02

[52] U.S. Cl. ..... 294/147; 294/152; 294/165

[58] Field of Search ..... 294/138, 141, 294/143, 146, 147, 150, 152, 156, 159, 162, 163, 165; 190/100, 102, 115; 206/315.1; 224/250, 917; 280/814, 815

[56] References Cited

U.S. PATENT DOCUMENTS

| | | | |
|---|---|---|---|
| 954,840 | 4/1910 | Wiedemann | 294/150 X |
| 2,422,235 | 6/1947 | Greene | 294/138 |
| 3,209,870 | 10/1965 | Johns | 224/917 X |
| 3,399,750 | 9/1968 | Woolworth | 224/917 X |
| 3,780,920 | 12/1973 | Green | 294/147 X |
| 3,892,343 | 7/1975 | Warner | 294/147 |
| 3,917,137 | 11/1975 | Wilkins | 294/147 |
| 3,935,977 | 2/1976 | Bonnett | 294/147 |
| 4,463,885 | 8/1984 | Ball et al. | 224/250 |
| 4,553,779 | 11/1985 | Shortridge | 294/147 |
| 4,674,787 | 6/1987 | DeVera | 294/147 |
| 4,729,591 | 3/1988 | Scalise | 294/141 |
| 4,746,159 | 5/1988 | Webb et al. | 294/147 |
| 4,792,073 | 12/1988 | Jacober | 224/202 |
| 4,951,816 | 8/1990 | Smith | 280/814 X |
| 5,012,921 | 5/1991 | Becker | 206/315.1 |
| 5,251,945 | 10/1993 | Stoops | 294/152 |

*Primary Examiner*—Johnny D. Cherry
*Attorney, Agent, or Firm*—John C. Smith

[57] ABSTRACT

A compact, lightweight foldable ski equipment and accessory carrier made from a soft flexible panel. In the carrying position, the panel folds to form two opposing walls which define a central storage area for skis and poles. Resealable straps are provided in the central storage area that hold the skis and poles in place with hook and loop material. The outside of the device has an additional set of boot retaining straps which hold ski boots securely. The boot retaining straps also use hook and loop material to secure the boots to the carrier. Integral resealable pockets are provided on the outer surface of the carrier to hold other items such as ski clothing, sunglasses, wallets, etc. A handle strap is provided to allow convenient carrying of the carrier device. In the closed position, the carrier walls fold such that the straps are enclosed within the carrier and the carrier forms a flat package for storage which is held in the closed position by hook and loop material.

18 Claims, 8 Drawing Sheets

COMPACT LIGHTWEIGHT FOLDABLE SKI EQUIPMENT CARRIER

BACKGROUND OF THE INVENTION

1. Technical Field

The present invention relates to carrier devices. In particular, it relates to foldable lightweight carriers which can transport an entire set of ski equipment including skis, poles and boots as well as providing pockets for ski outfits, glasses, etc., and when not transporting equipment, can easily be folded to fit within a ski locker for safe storage while the user is skiing.

2. Background Art

Skiing is a sport which requires numerous items of special equipment which due to their odd shapes and sheer weight can be inconvenient to carry. In particular, the skis and poles are too long to be accommodated by a general purpose carrier such as luggage, while other equipment such as ski boots tend to be too bulky, awkward, or heavy for many luggage cases. As a result, the prior art has attempted to provide devices suitable for carrying the uniquely shaped equipment used by skiers. While improving the ease with which skiers can transport various combinations of skiing equipment, these devices are typically either too large or odd shaped to fit within a ski locker such that they can be safely stored while the skier is on the ski slopes.

One category of known devices are clamping devices which hold skis and poles. These devices allow for more convenient carrying of the skis and poles but do not provide for the other items of equipment such as boots, clothing, etc. A drawback to this category of device is that the other items of equipment, such as boots, sunglasses, clothing, etc., must be carried separately.

In addition, the size of the device, either due to its shape, its sheer bulk, or the materials used to construct it (i.e., rigid plastic or metal) does not allow convenient and safe storage while the user is skiing because the size of a typical ski locker is too small to accommodate the device. As a result, the carrier is exposed to theft or damage while its owner is skiing.

Boot carriers have also been developed to provide a more convenient way of transporting bulky ski boots. Some boot carriers also contain storage pockets for small items, but do not provide the ability to hold skis and poles. As was the case above, this category of device provides only a partial solution since it does not have the capacity to transport all of the equipment used by a skier, and in addition, will not fit in a typical ski locker.

Another problem confronting skiers is the possibility of damaging equipment by dropping one or more items. When dropped, the equipment can be scratched, broken, etc. An advantage of the device disclosed herein is that all of the ski equipment can be carried by a single device. When ski equipment is carried separately, the possibility of dropping an item of ski equipment is increased. Likewise, since the device embodying the preferred embodiment is constructed of soft material, even if the carrier is dropped the possibility of damage to equipment is reduced.

A third category of devices have been developed which carry boots, skis and poles. These devices are typically either too rigid and/or bulky to conveniently fit within a ski locker.

The prior art has failed to provide a carrier device which is simple and lightweight in construction, which provides a soft flexible form to help protect equipment if dropped, which is capable of carrying any or all of the ski equipment desired by the skier, and which is capable of folding into a compact size for safe storage in a ski locker while the skier is skiing.

SUMMARY OF THE INVENTION

The present invention solves the foregoing problems by providing a soft, lightweight, and foldable ski equipment carrier which is made from a flexible panel. The preferred embodiment has an open, a closed, and a carrying position. In the carrying position, the flexible panel folds to form two walls which define a central storage area for skis and poles that are held securely in place by ski retaining straps secured by hook and loop material. The outside of the device has a set of boot retaining straps which hold ski boots securely in place. The boot retaining straps also use hook and loop material to secure the boots to the carrier. Resealable pockets are provided on the outer surface of the carrier to hold other items such as ski clothing, sunglasses, wallets, etc. A handle strap is provided to allow convenient carrying of the carrier device either by hand or over the shoulder. The carrier is constructed from soft water resistant material (such as fabric, canvas, nylon, etc.), to provide additional protection to the ski equipment if the carrier is dropped. Each item of equipment is secured to minimize movement when in the carrier and thereby prevent inadvertent damage to equipment. In the open position, the flexible panel lays flat to allow easy access when securing the skis and/or poles to the ski retaining straps. When not in use, the carrier is folded into the closed position. In the closed position, the carrier walls fold such that the straps are enclosed within the carrier and the carrier forms a flat compact package for storage which is held in the closed position by closure strips made of hook and loop material.

DESCRIPTION OF THE PREFERRED EMBODIMENT

Figure 1:
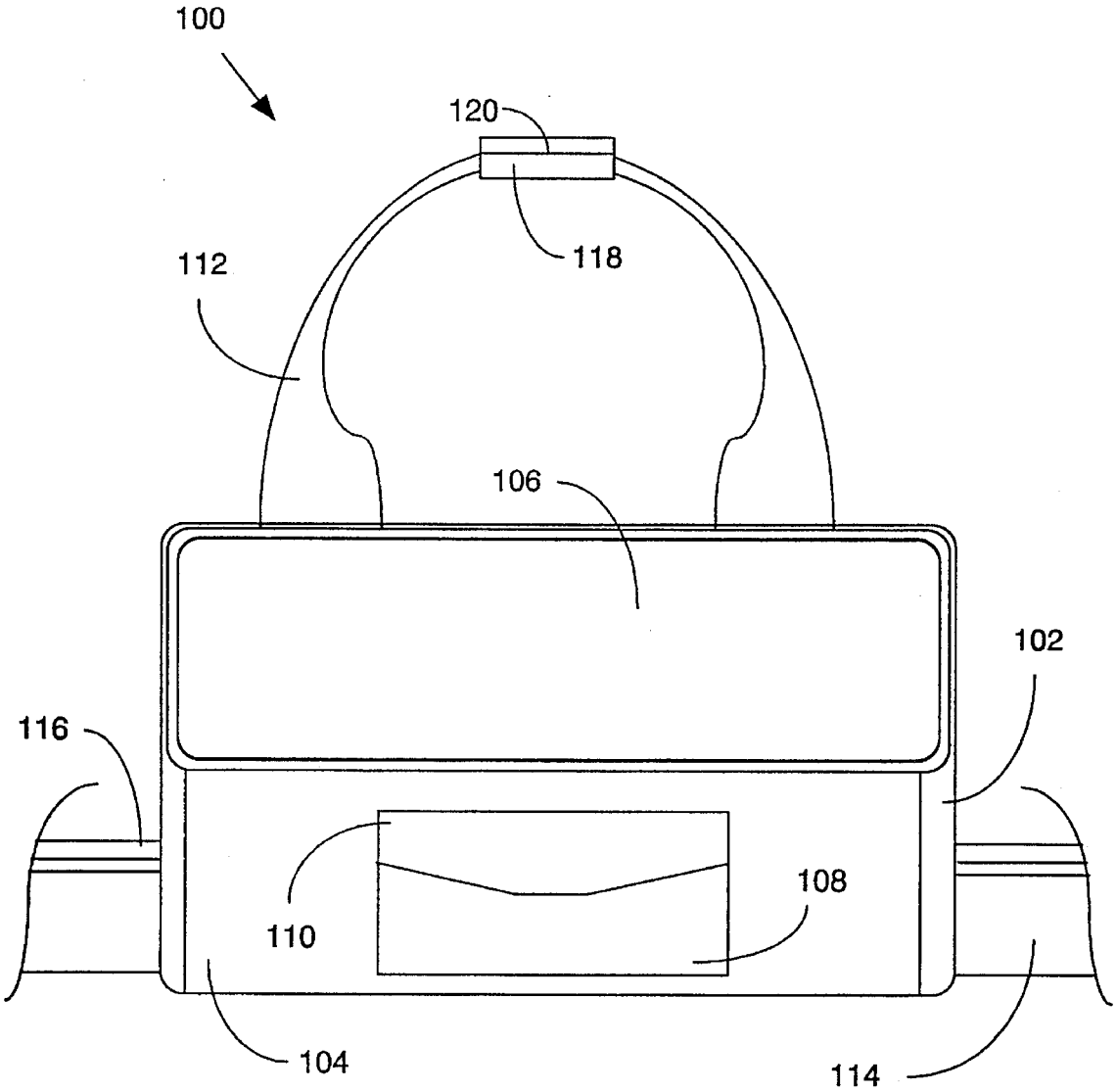
FIG. 1 is a diagram showing a frontal side view of a preferred embodiment of the ski carrier in the carrying position. This view illustrates the storage pockets on the outside of the carrier.

Prior to a detailed discussion of the figures, a general discussion of the features and advantages of the carrier device 100 will be presented. A principle feature of the carrier disclosed herein is its ability not only to conveniently carry the skis, poles and boots of a skier in one carrier, but also to carry other paraphernalia such as ski clothes, sunglasses, wallets, etc.

A second advantage of the device is its ability, after the ski equipment has been unloaded, to be folded into a flat closed position which is small enough to fit into a ski locker. Ski lockers typically have sizes approximately 10 to 12 inches wide, 1.5 to 2 feet high, and 36 inches deep. The ability to secure the carrier in a lockable ski locker avoids problems which prior art carriers are exposed to. In particular, since prior art carriers are typically too large for lockers, they are usually left unattended in exposed areas while skiers are on the ski slopes and are subject to damage and or theft.

A third advantage of the preferred embodiment disclosed herein is simplicity of the structure and materials used which permits inexpensive manufacture and ease of use. The structural design is based on the use of a single flexible panel which folds to form first and second wall portions (hereinafter front wall 102 and rear wall 202). The flexible panel has. exterior surfaces manufactured from fabric material. Any suitable fabric which holds color, is water resistant, and possesses suitable strength can be used. In the preferred embodiment, the flexible panel also includes an interior flexible support panel which can be cardboard, flexible plastic, etc. Other portions of the carrier can be fabricated from materials suitable for the particular use. For example, the carrying strap can be manufactured from high strength synthetic fabrics, such as nylon, etc, to safely support the weight of the carrier and equipment.

The carrier has three basic positions: carrying, open and closed. In the carrying position, the flexible panel is folded such that two walls are formed, one by each end of the carrier, which face one another and form a central storage area 516 which provides straps to secure skis and ski poles. On the outside of one of the walls, additional straps and holders are provided to secure (and protect) ski boots to the outside wall of the carrier. In addition, on the other wall several sealable pockets are provided for storage of clothing, lift tickets, sunglasses, wallets, etc. In the open position, the flexible panel is laid flat to allow easy attachment of the ski equipment. In the closed position, the panel walls are folded twice, first into the carrying position and then folded a second time and secured together to provide a compact form factor which is suitable for storage in a typical ski locker.

Due to the folding nature of the carrier, a skier can easily load the ski equipment into the carrier when it is in the open position, can conveniently carry all of the equipment needed to ski when in the carrying position, and when in the closed position, the skier can collapse the carrier into a compact enough form factor to allow the carrier to be securely stored in a ski locker. A still further advantage of the form factor of the carrier when in the closed position is that the generally rectangular shape also permits more convenient storage when the carrier is returned to the user's home. Small items, such as the skier's sunglasses, can be stored in the carrier when it is in the closed position.

Referring to FIG. 1, a front side view of a preferred embodiment is shown in the carrying position. In this view, front wall 102 is shown. Front wall 102 is attached at the bottom to rear wall 202 (shown in FIG. 2). When in the carrying position, the two walls 102, 202 form a central storage area 516 (shown in FIG. 5) which provides storage space for skis 114 and ski poles 116. For ease of illustration, skis 114 and ski poles 116 are shown mounted in the central storage area 516 of carrier 100. Carrier 100 can be constructed of any suitable material so long as it retains the ability to be folded into the open, carrying or closed positions.

In the preferred embodiment, carrier 100 is fabricated from either a durable cloth material such as canvas, or from a durable synthetic material such as nylon or equivalent. The use of natural or synthetic materials such as canvas or synthetic fibers provides high strength, low weight, and the additional advantage of being easily cleaned. Of course, any materials capable of providing the function described herein can be used.

Figure 2:
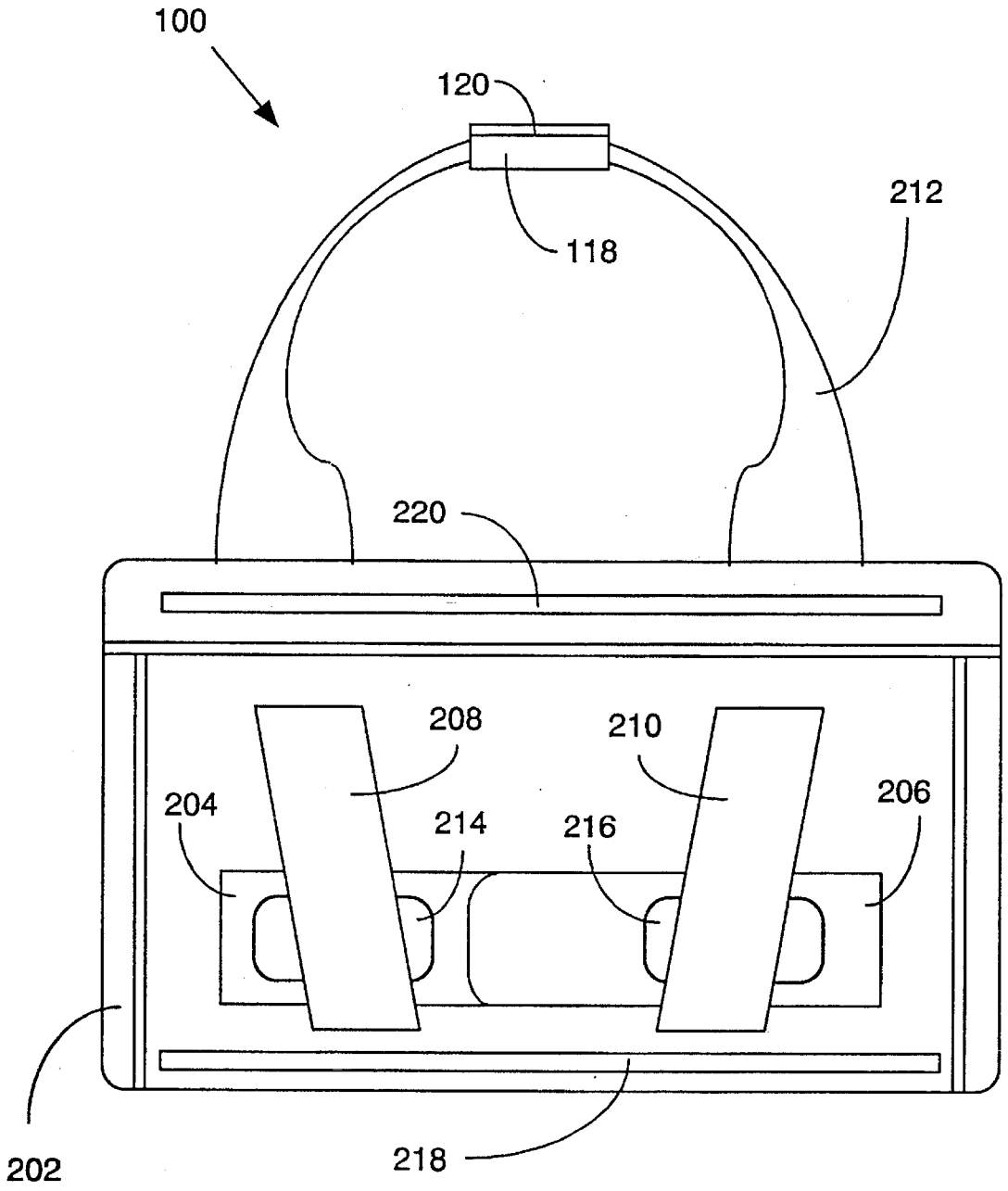
FIG. 2 shows a diagram of a rear side view of the embodiment of FIG. 1 in the carrying position. This view illustrates the boot retaining straps and closure strips on the outside of the carrier.

Handles 112, 212 (212 is shown in FIG. 2) are attached respectively to front and rear walls 102, 202 to facilitate transporting carrier 100 when it is filled with ski equipment. Those skilled in the art will recognize that handles 112, 212 can be constructed from a variety of materials, including fabrics, wood, metal, plastics, etc. In a preferred embodiment, handles 112, 212 are constructed from the same material used to fabricate automobile seat belts. They can, however, be fabricated from the same material used to fabricate front and rear walls 102, 202. An additional advantage associated with fabricating handles 112, 212 from flexible materials is that they can be easily folded between front and rear walls 102, 202 for more compact storage when in the closed position. To provide more comfortable carrying, an optional removable grip 118 is also shown. Removable grip 118 can be wrapped around both handles 112, 212 and secured along seam 120 by hook and loop material (not shown). In addition, removable grip 118 can be sized for hand carrying or to provide a cushion when carrier 100 is transported by resting handles 112, 212 over the skier's shoulder.

Front wall 102 also provides support for large pocket 104. In the preferred embodiment, large pocket 104 covers a substantial portion of the surface area of front wall 102 to provide the maximum amount of available space for items such as ski accessories. Large pocket resealable lid 106 is a resealable flexible flap which folds over the top of large pocket 104 to hold in its contents and also to keep the elements out. In the preferred embodiment, large pocket resealable lid 106 is secured to large pocket 104 with hook and loop strips 504, 506 (shown in FIG. 5).

In addition to large pocket 104, a second small pocket 108 is attached to the surface of large pocket 104. Small pocket 108 is used to hold smaller items such as sunglasses, wallets, lift tickets, etc. Small pocket 108 also has a small pocket resealable lid 110 that is also secured by hook and loop strips 508, 510 (shown in FIG. 5). Those skilled in the art will recognize that a variety of devices can be used to seal large pocket 104 and small pocket 108. For example, zippers, buttons, snaps, etc. can be substituted for the hook and loop material used in the preferred embodiment.

In FIG. 2, a rear side view of the preferred embodiment of FIG. 1 is shown. As was the case with FIG. 1, this figure is also shown in the carrying position. In this view, rear wall 202 is shown. As discussed above, rear wall 202 is attached at the bottom to front wall 102. During use, boots are held against rear wall 202 of carrier 100 by straps 204, 206, 208, 210. In the preferred embodiment, straps 204 and 206 are shown as two separate straps that are held together by hook and loop material (not shown). Of course, straps 204, 206 could easily be replaced with a single strap that is releasably secured at one end to rear wall 202. As was the case above, in the discussion of pockets 104, 108, alternative securing devices such as buckles, zippers, etc. could be used in place of hook and loop material.

Straps 208, 210 are attached at one end to rear wall 202 and are secured to straps 204, 206 by hook and loop material 214, 216, respectively.

Hook and loop closing strips 218, 220 are shown near the top and bottom of rear wall 202. These closing strips 218, 220 are not used when carrier 100 is in the carrying position. They are joined together to hold carrier 100 in the closed position. Strips 218, 220 are discussed more fully below in regard to FIG. 6.

Figure 3:
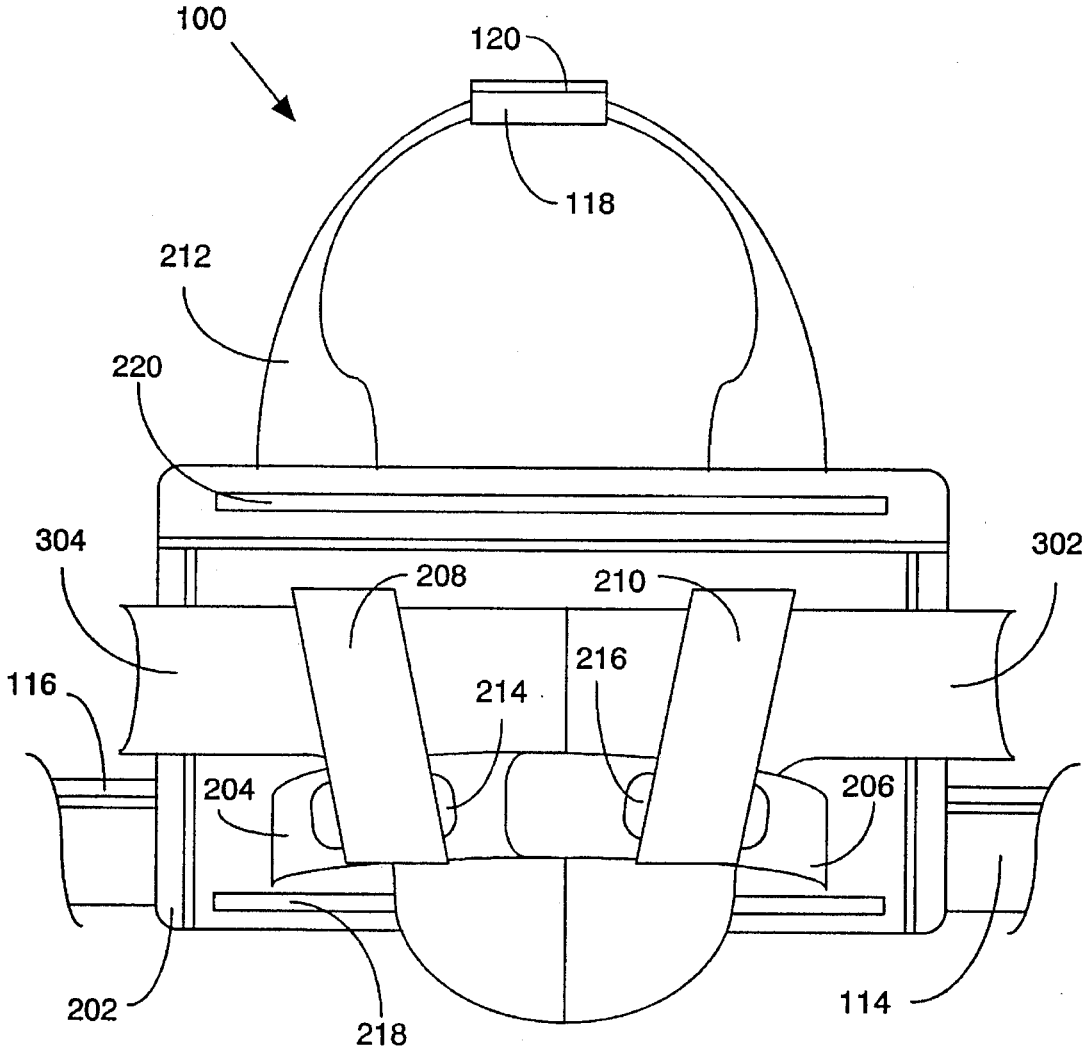
FIG. 3 shows the embodiment of FIG. 2 in the carrying position. This view illustrates how the boot is held by the boot retaining straps.

FIG. 3 illustrates the carrier 100 in the carrying position with boots 302, 304 secured to rear wall 202. As can be seen straps 204, 206 secure the toes of the boots 302, 304 while straps 208, 210 secure the ankle portions of boots 302, 304. By securing the boots 302, 304 in this fashion, they are prevented from slipping out of the carrier during use. Those skilled in the art will recognize that a variety of changes can be made to the preferred embodiment. For example, the particular orientation of boot retaining straps 204, 206, 208, 210 can vary. Likewise, boot retaining straps 208, 210 can also be replaced with a single strap which extends over both boots 302, 304.

Figure 4A:
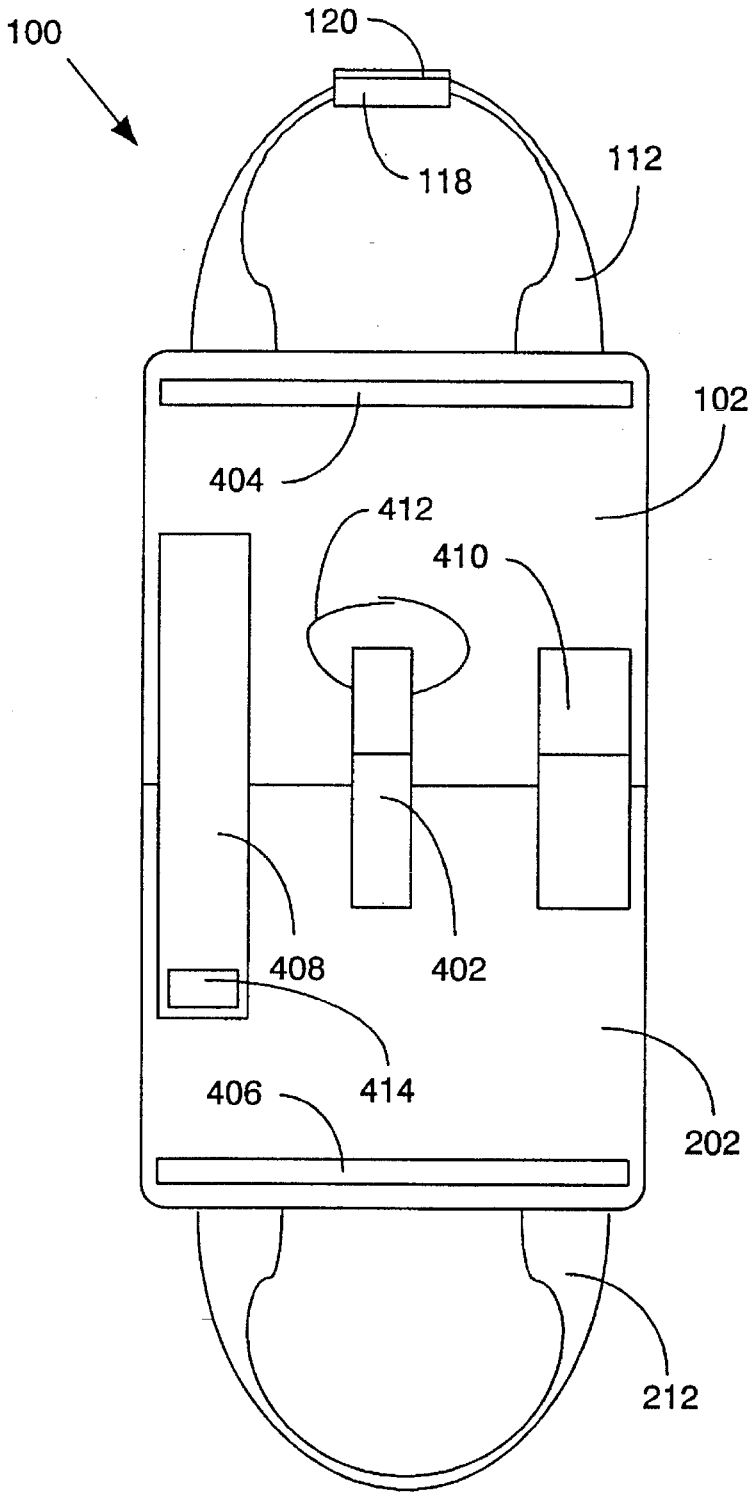
FIG. 4A shows the embodiment of FIG. 1 in the open position with the opposing wall segments laid flat to expose the ski retaining straps on the inside of the carrier.

In FIG. 4A, the inner surface of carrier 100 is illustrated in the open position. This figure shows the inner surface which forms central storage area 516 when front and rear walls 102, 202 are folded together into the carrying position. The carrying position is intended in this discussion to indicate the configuration used to carry ski equipment, the closed position is intended to indicate the configuration used for storage, and the open position is intended to indicate the flattened position used when initially securing ski equipment to carrier 100.

As can be seen, front wall 102 and rear wall 202 are opposing portions of a single flat piece of material. Also illustrated in this figure are ski retaining straps 402, 408, 410. When skis 114 and ski poles 116 are being transported, they are secured to the central storage area 516 by ski retaining straps 402, 408, 410. In the preferred embodiment, the outside ski retaining straps are wider to accommodate the bindings on the skis. In the preferred embodiment, ski retaining straps 402, 408, 410 are releasably secured by hook and loop strips 502, 512 (shown in FIG. 5). As was the case above, ski retaining straps 402,408, 410 can have alternative securing devices, such as buckles, but hook and loop material is preferred for its low cost and ease of use. The number of ski retaining strap 402, 408, 410 used is not critical so long as the skis 114 and ski poles 116 are securely held. In fact, a single wide ski retaining strap 402, 408, 410 can be used in place of the plurality of narrow ski retaining strips 402, 408, 410 shown. In addition, loop 412 is shown wrapped around ski retaining strap 402. For ease of illustration, only one loop 412 is shown. However, in practice several loops 412 would be used by a carrier. Loops 412 are secured at their ends by hook and loop material. Prior to securing skis 114 and ski poles 116 to carrier 100, individual skis 114 and/or ski poles 116 are secured to one another by loops 412. By so doing, handling of skis 114 and ski poles 116 is more convenient when they are secured to carrier 100 and when they are removed. By attaching loops 412 to ski retaining straps 402, 408, 410 when carrier 100 is empty, the possibility of inadvertently losing loops 412 is reduced.

Also shown in this figure are wall retaining strips 404, 406. When carrier 100 is placed in the carrying or closed positions, wall retaining strips 404, 406 are joined to secure the front and rear walls 102, 202 together. Handle straps 112, 212 are also shown in this figure. As illustrated by this and the preceding figures, carrier 100 can be fabricated with great economy in terms of the number of components required. As a result, carrier 100 can be manufactured advantageously at low cost.

Figure 4B:
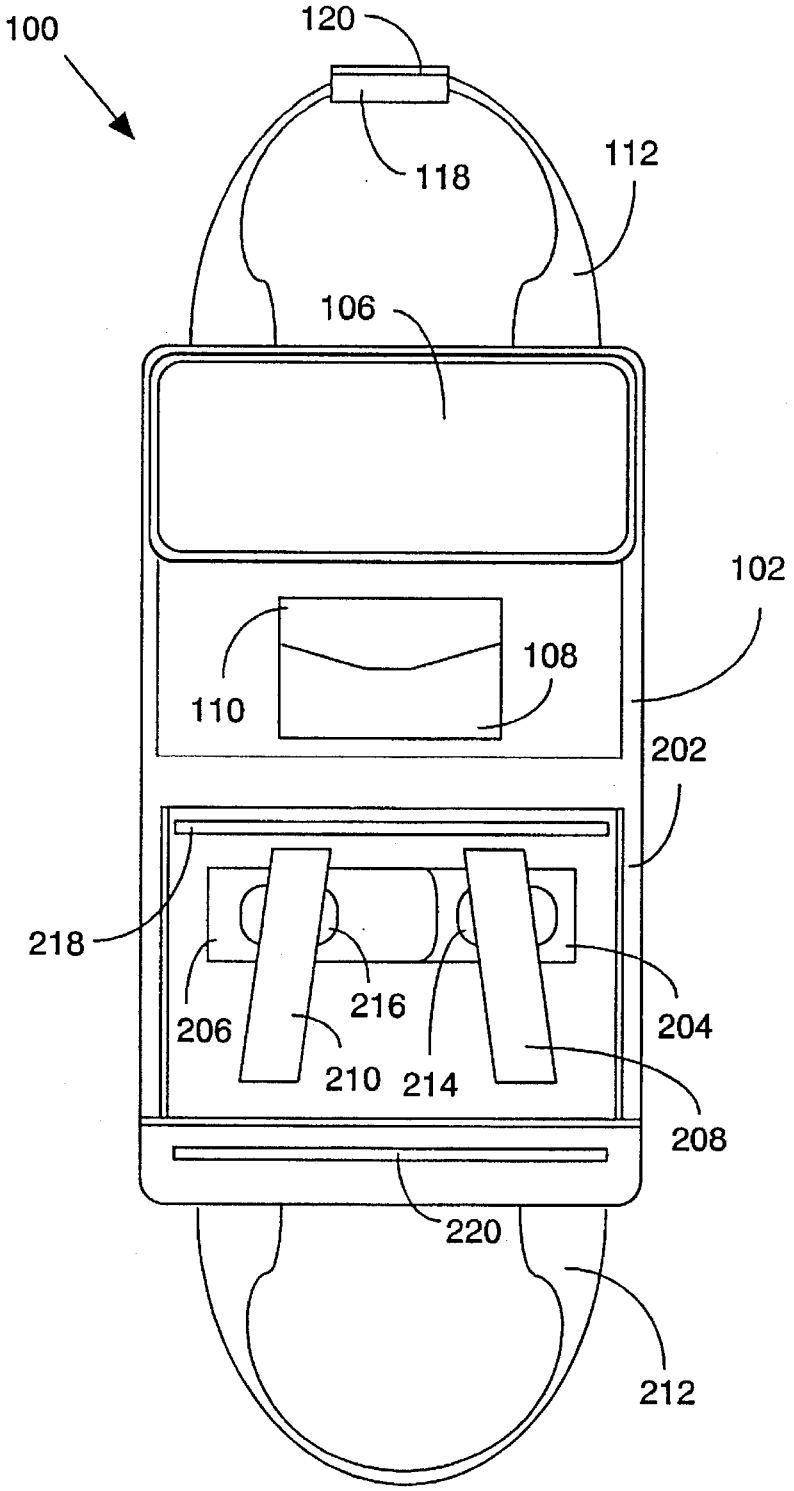
FIG. 4B shows the embodiment of FIG. 1 in the open position with the opposing wall segments laid flat to expose the boot retaining straps and pockets on the outside of the carrier.

FIG. 4B illustrates the outer surface of carrier 100 in the open position. As can be readily seen from this figure, the use of a single flexible panel provides the ability to manufacture carrier 100 inexpensively and with relative ease.

Figure 4C:
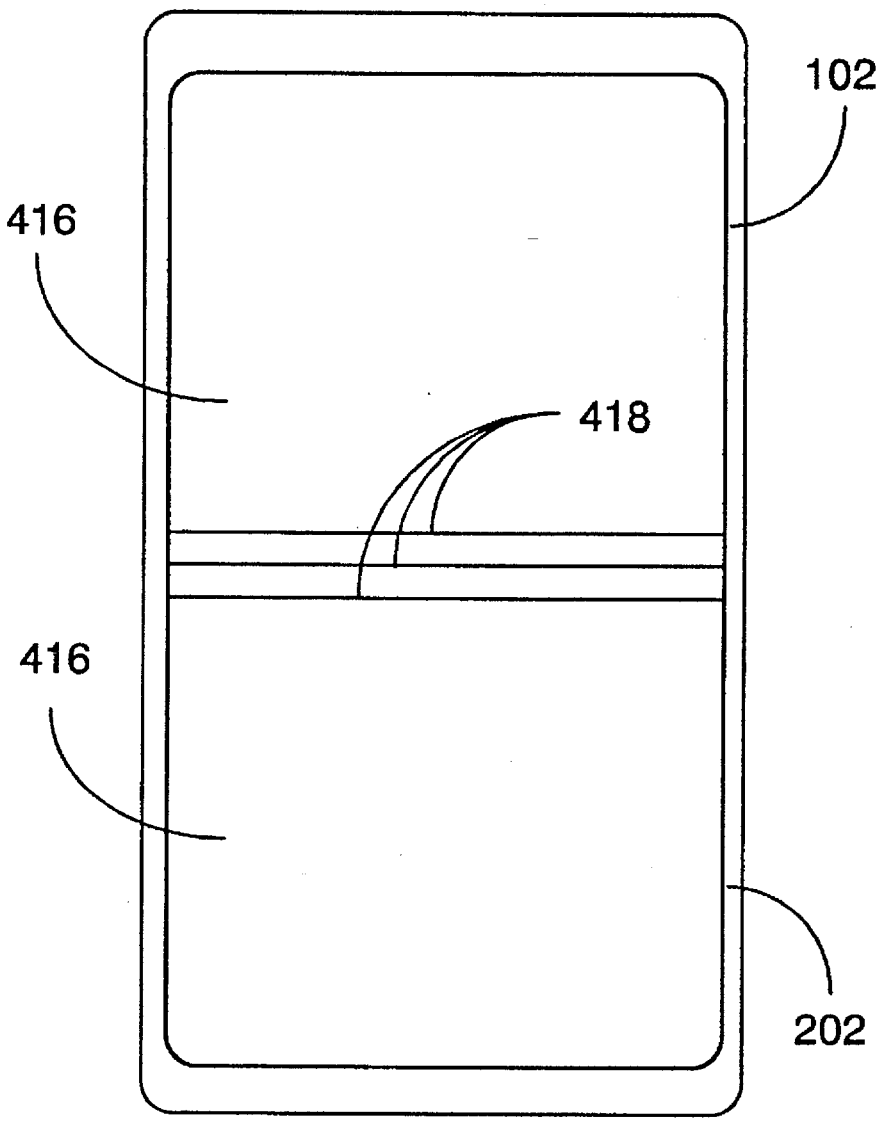
FIG. 4C shows a cutaway view of the embodiment of FIG. 1 in the open position with a reinforcing interior panel mounted inside the walls of the carrier.

In FIG. 4C, a cutaway view of carrier 100 is shown in the open position. In this view, an optional reinforcing interior panel 416 made from flexible material such as cardboard or plastic can be inserted into front and rear walls 102, 202 to provide structural support and help carrier 100 maintain its shape. In a preferred embodiment, the reinforcing interior panel is a single sheet which extends substantially across the length of front and rear walls 102, 202. To facilitate folding carrier 100 from the open to the closed position, scoring lines 418 are cut into the reinforcing panel 416 near the boundary between front and rear walls 102, 202. Of course, the reinforcing interior panel 416 can be made in separate segments, one for each of the front and rear walls 102, 202.

Figure 5:
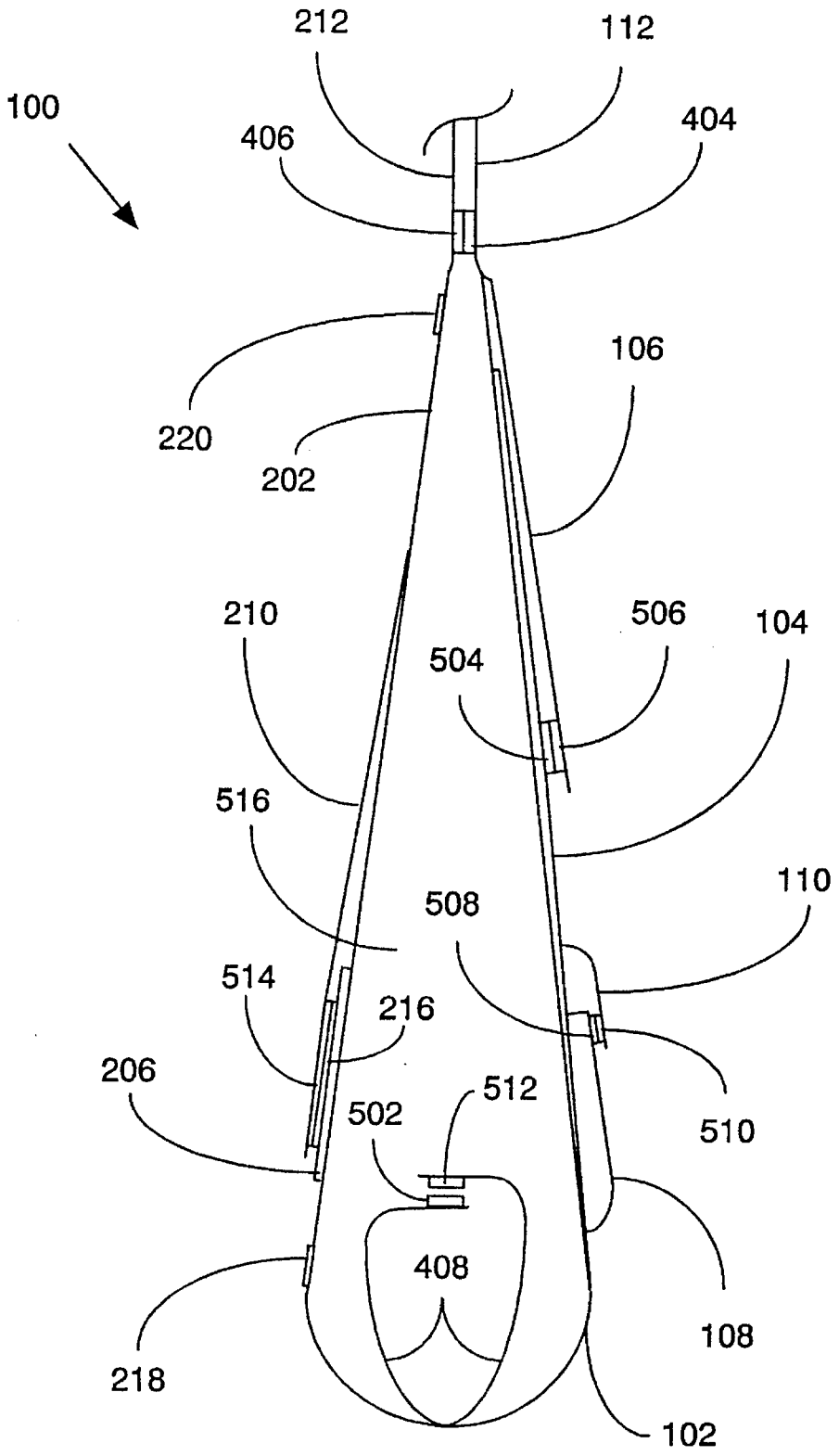
FIG. 5 is an end view of the embodiment of FIG. 1 in the carrying position. The ski retaining straps, boot retaining straps, and storage pockets are shown.

In FIG. 5, an end view of carrier 100 in the carrying position is shown. Hook and loop strips 508, 510 are shown securing small pocket 108 to small pocket resealable lid 110, and hook and loop strips 504, 506 are shown securing large pocket 104 to large pocket resealable lid 106. Strap 210 is also shown secured to strap 206 by hook and loop strips 216, 514.

Figure 6:
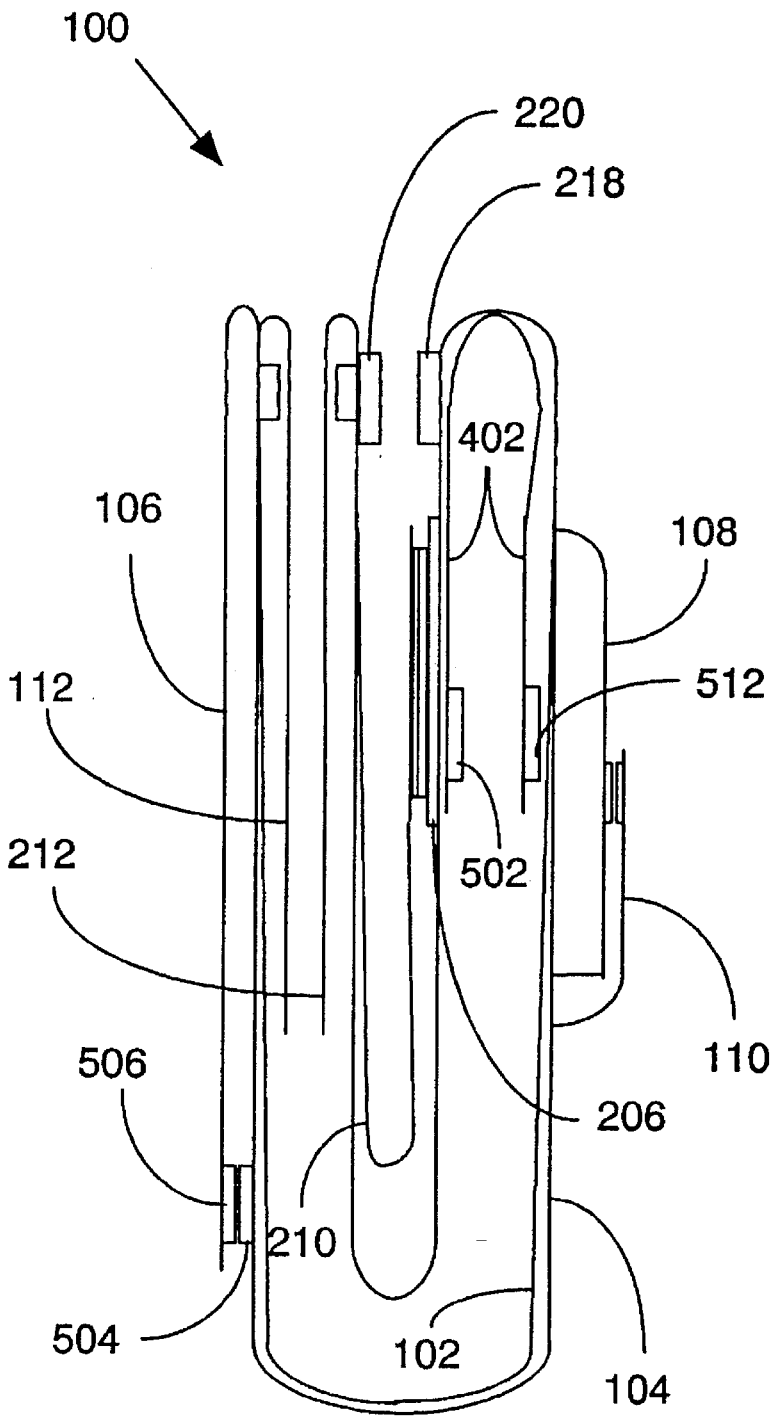
FIG. 6 is an end view of the embodiment of FIG. 1 in the closed position.

FIGS. 1 through 5 have illustrated carrier 100 either in the open or carrying position to better show the location of the components used and how ski equipment is carried. In FIG. 6, carrier 100 is shown in the closed (i.e. storage) position. As can be seen in this figure, front and rear walls 102, 202 are folded a second time to halve the height required in the carrying position. In addition, handle straps 112, 212 can be folded between front and rear walls 102, 202 such that they are enclosed for more compact storage. Likewise, when closing strips 218, 220 are joined, boot retaining straps 204, 206, 208, 210 are securely stored with the closed carrier 100.

An advantage achieved by the collapsible nature of carrier 100 is the ability to expand carrier 100 during use to a size sufficient to carry all equipment required by the skier while at the same time providing the ability to fold carrier 100 into the minimum amount of space when in-the closed position. In particular, the closed position allows carrier 100 to be conveniently stored in a ski locker while the skier is skiing, thereby avoiding problems such as damage and theft.

While the invention has been described with respect to a preferred embodiment thereof, it will be understood by those skilled in the art that various changes in detail my be made therein without departing from the spirit, scope, and teaching of the invention. For example, fabrication materials can vary, a variety of securing devices can be substituted for hook and loop materials, the orientation of the boot retaining straps can vary, flexible reinforcing panels can be inserted into the walls of the carrier, handle grips can be added, etc. Accordingly, the invention herein disclosed is to be limited only as specified in the following claims.

I claim:

1. A foldable carrier for transporting ski equipment, comprising:

a substantially flat panel having an inside surface and an outside surface and further having a first wall portion and a second wall portion, the panel being foldable such that it can be placed in an open position, a carrying position, or a closed position; further, when in the carrying position a central storage area is formed when the first wall portion and the second wall portion are folded towards one another, and when in the closed position the first wall portion and the second wall portion each being foldable such that the second wall portion folds into at least two segments and the first wall portion folds into at least two segments;

at least one ski retention strap attached to the inside surface of the panel;

at least one boot retention strap attached to the outside surface of the panel on a first wall portion; and at least one carrying strap attached to the panel for transporting the carrier;

whereby the foldable carrier is capable of transporting ski equipment in the carrying position and further capable of folding into a closed position for compact storage.

2. A foldable carrier, as in claim 1, wherein the boot retention strap further comprises:

at least one substantially horizontal strap attached to the panel, the horizontal strap having a length sufficient to fit over and releasably secure a portion of a ski boot to the carrier; and at least one substantially vertical strap attached to the panel, the vertical strap having a length sufficient to fit over a ski boot and be releasably secured to the horizontal strap.

3. A foldable carrier, as in claim 2, wherein the horizontal strap and the vertical strap are releasably secured by hook and loop material.

4. A foldable carrier, as in claim 3, wherein the ski retention strap is releasably secured by hook and loop material.

5. A foldable carrier, as in claim 4, further comprising:

a first pocket attached to the first wall portion;

a first resealable lid attached to the first wall portion at one end and releasably attached to the first pocket on the other end.

6. A foldable carrier, as in claim 5, further comprising:

a second pocket attached to the first pocket;

a second resealable lid attached to the first pocket at one end and releasably attached to the second pocket on the other end.

7. A foldable carrier for transporting ski equipment, comprising:

a substantially flat panel having an inside surface and an outside surface and further having a first wall portion and a second wall portion, the panel being foldable such that it can be placed in an open position, a carrying position, or a closed position; further, when in the carrying position a central storage area is formed when the first wall portion and the second wall portion are folded towards one another, and when in the closed position the first wall portion and the second wall portion each being foldable such that the second wall portion folds into at least two segments and the first wall portion folds into at least two segments, when in the closed position, the carrier further having a height less than twelve inches, a width less than thirty six inches, and a depth less than eight inches;

at least one ski retention strap attached to the inside surface of the panel;

at least one boot retention strap attached to the outside surface of the panel on a first wall portion; and at least one handle attached to the panel for transporting the carrier;

whereby the foldable carrier is capable of transporting ski equipment in the carrying position and further capable of folding into a closed position for compact storage.

8. A foldable carrier, as in claim 7, wherein the boot retention strap further comprises:

at least one substantially horizontal strap attached to the panel, the horizontal strap having a length sufficient to fit over and releasably secure a portion of a ski boot to the carrier; and at least one substantially vertical strap attached to the panel, the vertical strap having a length sufficient to fit over a ski boot and be releasably secured to the horizontal strap.

9. A foldable carrier, as in claim 8, wherein the horizontal strap and the vertical strap are releasably secured by hook and loop material.

10. A foldable carrier, as in claim 9, wherein the ski retention strap is releasably secured by hook and loop material.

11. A foldable carrier, as in claim 10, further comprising:

a first pocket attached to the first wall portion;

a first resealable lid attached to the first wall portion at one end and releasably attached to the first pocket on the other end.

12. A foldable carrier, as in claim 11, further comprising:

a second pocket attached to the first pocket;

a second resealable lid attached to the first pocket at one end and releasably attached to the second pocket on the other end.

13. A foldable carrier for transporting ski equipment, comprising:

a substantially flat flexible panel having an inside surface and an outside surface and further having a first wall portion and a second wall portion, the flexible panel being foldable such that it can be placed in an open position, a carrying position, or a closed position; further, when in the carrying position a central storage area is formed when the first wall portion and the second wall portion are folded towards one another, and when in the closed position the first wall portion and the second wall portion each being foldable such that the second wall portion folds into at least two segments and the first wall portion folds into at least two segments;

a reinforcing interior panel enclosed between the inside surface and the outside surface of the flexible panel;

at least one ski retention strap attached to the inside surface of the panel;

at least one boot retention strap attached to the outside surface of the panel on a first wall portion; and at least one carrying strap attached to the panel for transporting the carrier;

whereby the foldable carrier is capable of transporting ski equipment in the carrying position and further capable of folding into a closed position for compact storage.

14. A foldable carrier, as in claim 13, wherein the boot retention strap further comprises:

at least one substantially horizontal strap attached to the panel, the horizontal strap having a length sufficient to fit over and releasably secure a portion of a ski boot to the carrier; and at least one substantially vertical strap attached to the panel, the vertical strap having a length sufficient to fit over a ski boot and be releasably secured to the horizontal strap.

15. A foldable carrier, as in claim 14, wherein the horizontal strap and the vertical strap are releasably secured by hook and loop material.

16. A foldable carrier, as in claim 15, wherein the ski retention strap is releasably secured by hook and loop material.

17. A foldable carrier, as in claim 16, further comprising:

a first pocket attached to the first wall portion;

a first resealable lid attached to the first wall portion at one end and releasably attached to the first pocket on the other end.

18. A foldable carrier, as in claim 17, further comprising:

a second pocket attached to the first pocket;

a second resealable lid attached to the first pocket at one end and releasably attached to the second pocket on the other end.

* * * * *